US010662890B2

(12) United States Patent
Reiling et al.

(10) Patent No.: US 10,662,890 B2
(45) Date of Patent: May 26, 2020

(54) METHOD FOR OPERATING AN INTERNAL COMBUSTION ENGINE AND ELECTRONIC CONTROL UNIT FOR AN INTERNAL COMBUSTION ENGINE

(71) Applicant: Robert Bosch GmbH, Stuttgart (DE)

(72) Inventors: Florian Reiling, Remchingen (DE); Christos Hondros, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 109 days.

(21) Appl. No.: 16/120,592

(22) Filed: Sep. 4, 2018

(65) Prior Publication Data

US 2019/0093594 A1 Mar. 28, 2019

(30) Foreign Application Priority Data

Sep. 26, 2017 (DE) ..... 10 2017 217 113

(51) Int. Cl.
*F02D 41/00* (2006.01)
*F02D 41/40* (2006.01)
(Continued)

(52) U.S. Cl.
CPC ..... *F02D 41/402* (2013.01); *F02D 41/008* (2013.01); *F02D 41/1401* (2013.01);
(Continued)

(58) Field of Classification Search
CPC .. F02D 41/402; F02D 41/008; F02D 41/1401; F02D 41/26; F02D 41/3827;
(Continued)

(56) References Cited

U.S. PATENT DOCUMENTS 6,992,403 B1 * 1/2006 Raad ..... F02C 7/275 290/10
8,816,556 B2 * 8/2014 Hao ..... H02K 1/30 310/156.01
(Continued)

FOREIGN PATENT DOCUMENTS

DE 10 2014 215 618 A1 2/2016

*Primary Examiner* — Phutthiwat Wongwian
*Assistant Examiner* — Sherman D Manley
(74) *Attorney, Agent, or Firm* — Norton Rose Fulbright US LLP; Gerard Messina

(57) ABSTRACT

A method for operating an internal combustion engine is provided in which fuel is withdrawn from a high-pressure accumulator and injected into a combustion chamber of at least one cylinder of the internal combustion engine, the method including the steps of detecting under conditions of angular synchronism a pressure of the fuel in the high-pressure accumulator during a first injection into the at least one cylinder and during a later, second injection into the at least one cylinder; ascertaining a gradient of the detected pressure; ascertaining a frequency-transformed spectrum of the detected pressure and a frequency-transformed spectrum of the ascertained gradient; correcting the frequency-transformed spectrum of the detected pressure by the frequency-transformed spectrum of the ascertained gradient; and ascertaining a cylinder-individual injection quantity of fuel, which was injected into the at least one cylinder, from the corrected frequency-transformed spectrum of the detected pressure.

9 Claims, 5 Drawing Sheets

(51) Int. Cl.

| | |
|---|---|
| ***F02D 41/14*** | (2006.01) |
| ***F02D 41/26*** | (2006.01) |
| *F02D 41/28* | (2006.01) |
| *F02D 41/38* | (2006.01) |

(52) U.S. Cl.
CPC ..... *F02D 41/26* (2013.01); *F02D 41/3827* (2013.01); *F02D 2041/1429* (2013.01); *F02D 2041/1433* (2013.01); *F02D 2041/288* (2013.01); *F02D 2041/389* (2013.01); *F02D 2200/0602* (2013.01); *F02D 2250/14* (2013.01)

(58) Field of Classification Search
CPC ..... F02D 41/38; F02D 41/3836; F02D 2041/288; F02D 2041/1429; F02D 2041/1433; F02D 2041/389; F02D 2200/0602; F02D 2250/14
See application file for complete search history.

(56) References Cited

U.S. PATENT DOCUMENTS 10,190,561 B1* 1/2019 Hao ..... F02N 11/0851
2003/0107348 A1* 6/2003 Inagawa ..... H02P 6/20 322/22
2005/0229889 A1* 10/2005 Hoevermann ..... F02D 41/009 123/179.4
2012/0256523 A1* 10/2012 Fulton ..... F02N 11/02 310/68 D
2012/0256524 A1* 10/2012 Fulton ..... F02N 15/067 310/68 E
2013/0133604 A1* 5/2013 Gray ..... F02N 11/0851 123/179.3
2013/0133605 A1* 5/2013 Neet ..... F02N 11/08 123/179.3
2013/0221681 A1* 8/2013 Bradfield ..... F02N 15/06 290/38 C
2013/0221682 A1* 8/2013 Bradfield ..... F02N 11/0855 290/38 C
2014/0035501 A1* 2/2014 Harada ..... H02P 6/16 318/400.35
2014/0260792 A1* 9/2014 Bradfield ..... F02N 11/0855 74/7 A
2014/0319957 A1* 10/2014 Hao ..... H02K 17/16 310/211
2015/0258882 A1* 9/2015 Holmes ..... B60K 6/485 180/65.26
2015/0260145 A1* 9/2015 Holmes ..... F02N 15/06 74/8
2017/0217426 A1* 8/2017 Hansen ..... F02P 5/1504
2018/0258900 A1* 9/2018 Namuduri ..... F02N 11/0848

* cited by examiner

METHOD FOR OPERATING AN INTERNAL COMBUSTION ENGINE AND ELECTRONIC CONTROL UNIT FOR AN INTERNAL COMBUSTION ENGINE

CROSS REFERENCE

The present application claims the benefit under 35 U.S.C. § 119 of German Patent Application No. DE 102017217113.8 filed on Sep. 26, 2017, which is expressly incorporated herein by reference in its entirety.

FIELD

The present invention relates to a method for operating an internal combustion engine, an electronic control unit for an internal combustion engine, a computer program as well as a machine-readable memory medium.

BACKGROUND INFORMATION

Controlling an injection of fuel into a combustion chamber of a cylinder of an internal combustion engine is a complex task. For example, a point of injection and an injection quantity of the fuel to be injected must be precisely determined. These two parameters may, however, change during an operation of the internal combustion engine, for example as a function of an operating point, and/or over a service life of the internal combustion engine.

A method is described in German Patent No. DE 10 2014 215 618 A1 in which a fuel injection quantity, which is withdrawn from a high-pressure accumulator of an injection system designed as a common-rail system and injected into one or multiple combustion chambers of the cylinders of an internal combustion engine, assigned in each case, is determined during the operation of the internal combustion engine. For this purpose, a fuel pressure in the high-pressure accumulator is detected as a function of an angle and transferred into a frequency-transformed pressure spectrum of the fuel pressure. The injection quantity is ascertained from an amplitude of the frequency-transformed pressure spectrum at the point in time of the ignition frequency of the internal combustion engine. The ascertained injection quantity corresponds in this case to the injection quantities averaged over all cylinders of the internal combustion engine.

It is desirable to operate an internal combustion engine in such a way that the injection of the internal combustion engine may be implemented particularly precisely and easily.

SUMMARY

According to a first aspect of the present invention, a method for operating an internal combustion engine is provided in which fuel is withdrawn from a high-pressure accumulator and injected into a combustion chamber of at least one cylinder of the internal combustion engine, the method including the steps of detecting under conditions of angular synchronism a pressure of the fuel in the high-pressure accumulator during a first injection into the at least one cylinder and during a later, second injection into the at least one cylinder; ascertaining a gradient of the detected pressure; ascertaining a frequency-transformed spectrum of the detected pressure and a frequency-transformed spectrum of the ascertained gradient; correcting the frequency-transformed spectrum of the detected pressure by the frequency-transformed spectrum of the ascertained gradient; and ascertaining a cylinder-individual injection quantity of fuel, which was injected into the at least one cylinder, from the corrected frequency-transformed spectrum of the detected pressure.

During the injection of fuel into a cylinder of an internal combustion engine, the pressure in the high-pressure accumulator (in particular of a common-rail system) may continuously increase over time, since, in the case of consecutive injections in which fuel is injected into the cylinder during a corresponding injection process, too little fuel may, for example, be withdrawn from the high-pressure accumulator and, at the same time, a continuously consistent amount of fuel may be delivered to the high-pressure accumulator with the aid of the delivery pump. Therefore, the pressure in the high-pressure accumulator may continuously increase. Alternatively, it may occur that over the course of multiple injections more fuel may be injected into the cylinder than may be replenished into the high-pressure accumulator, so that the pressure in the high-pressure accumulator may continuously decrease. Both pressure changes may thus occur dynamically during the operation of the internal combustion engine.

This pressure gradient may superimpose the pressure signal in the high-pressure accumulator which returns periodically with each injection process and which may be characterized per injection by a pressure drop due to the injection and by a pressure increase due to the replenishment of the high-pressure accumulator. In order to still be able to precisely determine a cylinder-specific injection quantity of the fuel, the pressure which is detected over a longer period of time with regard to the rotation angle of the crankshaft, i.e., to the crankshaft rotation angle or, in short, crankshaft angle, may be analyzed under conditions of angular synchronism for the purpose of ascertaining a gradient of the detected pressure. The gradient of the detected pressure may, for example, correspond to the continuous pressure change (for example pressure increase or pressure drop) in the high-pressure accumulator. The detected pressure as well as the ascertained gradient may be transferred to the frequency space, for example with the aid of a discrete Fourier transformation, so that a frequency-transformed spectrum of the detected pressure, or in other words a frequency-transformed pressure spectrum, and a frequency-transformed spectrum of the ascertained gradient, i.e., in other words, a frequency-transformed gradient spectrum, may be computed. The frequency-transformed pressure spectrum is corrected by the frequency-transformed gradient spectrum, so that the cylinder-individual injection quantity of the fuel may be ascertained from the corrected frequency-transformed pressure spectrum for the first and/or the second injection(s) in the case of the injection frequency. For this purpose, a model may be used, for example, in which the detected pressure and the fluid temperature may be model variables for the injection quantity. For example, the amplitude and/or phase of the corrected pressure spectrum for each injection may be ascertained separately in the case of the injection frequency and these values may be used to ascertain the particular injection quantity using a characteristic map function which sets these values in relation to the injection quantity.

The method according to the present invention may therefore include few computing steps during the running time of the method, so that it may be efficiently implemented in the engine controller. Compared to a compensation of the pressure gradient, which is measured as a function of the crankshaft rotation angle, in the angle space in which the detected pressure would have to be corrected by the pressure gradient prior to the frequency transformation, fewer computing steps are necessary, since not all measured data must be modified prior to the frequency transformation. The compensation of the pressure gradient may prevent the injection quantity ascertained with the aid of the model from being falsified, so that the injection may be implemented easily and precisely when it takes place taking into consideration the ascertained injection quantity. Furthermore, the injection quantity may also be precisely ascertainable in the case of not steady-state pressure conditions over the course of many injections.

In the method, the high-pressure accumulator may be supplied with fuel by a high-pressure pump with the aid of two delivery strokes, so that the pressure signal of the injection may be advantageously separable from a pump signal.

When carrying out the method, an operating point of the internal combustion engine may be essentially the same.

In one specific embodiment, the gradient may be ascertained by modeling a pressure change between the first injection and the second injection with the aid of a linear function. This measure may be based on the idea that the gradient increases or drops linearly in a first approximation over the course of the injection processes to be evaluated. The linear function may have a linear ascending slope and/or be a straight line, for example. This measure may thus represent a simple implementation of the method which may take into account the pressure change in a first approximation.

In one specific embodiment of the present invention, a first group of pressure values may be taken into consideration in a first evaluation window for the first injection and a second group of pressure values may be taken into consideration in a second evaluation window for the second injection when ascertaining the gradient. Here, a length of the evaluation windows in the angle space assigned to the particular injection may be freely selected. In particular, the lengths of the two evaluation windows may be the same. A beginning of the particular evaluation window may be defined by the expected point of injection and/or a length of the particular evaluation window may be defined by the expected injection duration. The ascertainment of the gradient may considerably simplify the modeling of the gradient by using discrete pressure values, since fewer measuring points must be taken into consideration. The selection of the evaluation windows may represent a minor computing effort when implementing the method.

In one specific embodiment of the present invention, the first group and/or the second group may include one or multiple pressure value(s). For example, the number of pressure values is equal in each of the groups. If the group includes only a single pressure value, this pressure value may, for example, be a detected pressure value or a pressure value averaged over multiple detected pressure values.

In one specific embodiment of the present invention, the pressure may increase over a detection period, during which the pressure may be detected under conditions of angular synchronism, and the gradient may be adapted to the first group of pressure values and to the second group of pressure values as a linearly ascending straight line. In other words, a straight line may be adapted to the pressure values of the first group and to the pressure values of the second group, so that the gradient of the pressure may be modeled using little computing effort.

In one specific embodiment of the present invention, the first and/or the second group(s) of pressure values may be selected at the beginning of the particular evaluation window. This measure may be based on the assumption that in the case of an identical operating point during multiple injection processes, the pressure in the high-pressure accumulator should be the same following a fuel withdrawal for the injection and refed fuel. The pressure increase or the pressure drop may thus be particularly apparent in the case of the selected second group of pressure values. In particular, at the beginning of the evaluation window, a pressure change due to the injection is not yet apparent, since it is possible that the pressure drop in the high-pressure accumulator takes place later.

In one specific embodiment of the present invention, correcting the frequency-transformed spectrum of the detected pressure may include forming a difference between the frequency-transformed spectrum of the detected pressure and the frequency-transformed spectrum of the gradient, i.e., subtracting the gradient spectrum from the pressure spectrum. This measure may represent a particularly simple correction of the frequency-transformed pressure spectrum.

Here, the modeled gradient may be transferred prior to its frequency transformation back to discrete pressure values, in particular via the entire detected angle range and at the same increments as the pressure values detected in this range, so that the transformation into the frequency space may be easily carried out.

More than two injections may be taken into consideration in the method, so that the precision of the method may be significantly improved.

It is noted that in all methods that work in the frequency space, i.e., which are able to use the amplitude or phase position of a frequency-transformed function or of frequency-transformed measured values as a feature, such gradients may impair a precision of the determination of these features. One possible example is the evaluation of a rotational speed signal which may change essentially approximately linearly as a function of the driving situation, for example in a coasting mode, a free-fall, etc. In this example, the relevant spectrum portion, i.e., the amplitude and/or phase, may be corrected with the aid of the method described above.

According to a second aspect of the present invention, an electronic control unit for an internal combustion engine is provided which is configured to carry out the steps of a method according to the first aspect. Here, the electronic control unit may be designed as a conventional processor, for example, on which a special computer program may run which controls the method according to the first aspect. Alternatively or additionally, the electronic control unit may be designed as an electronic engine control unit or be accommodated in same. Alternatively or additionally, the electronic control unit may include corresponding units which may carry out one or multiple method steps. Here, the electronic control unit and the units may be implemented with the aid of corresponding circuits, for example.

According to a third aspect of the present invention, a computer program is provided which is configured to carry out the steps of a method according to the first aspect, when it is carried out by a processor, in particular of the electronic control unit. The computer program, for example the above-named special computer program, may include instructions and form a control unit code which includes an algorithm for carrying out the method.

According to a fourth aspect of the present invention, a machine-readable memory medium is provided on which a computer program according to the third aspect is stored. The machine-readable memory medium may be designed as an external memory, as an internal memory, as a hard disk, or as a USB memory device, for example.

BRIEF DESCRIPTION OF THE DRAWINGS

Preferred specific embodiments of the present invention are explained in greater detail below on the basis of the figures.

DETAILED DESCRIPTION OF EXAMPLE EMBODIMENTS

Figure 1:
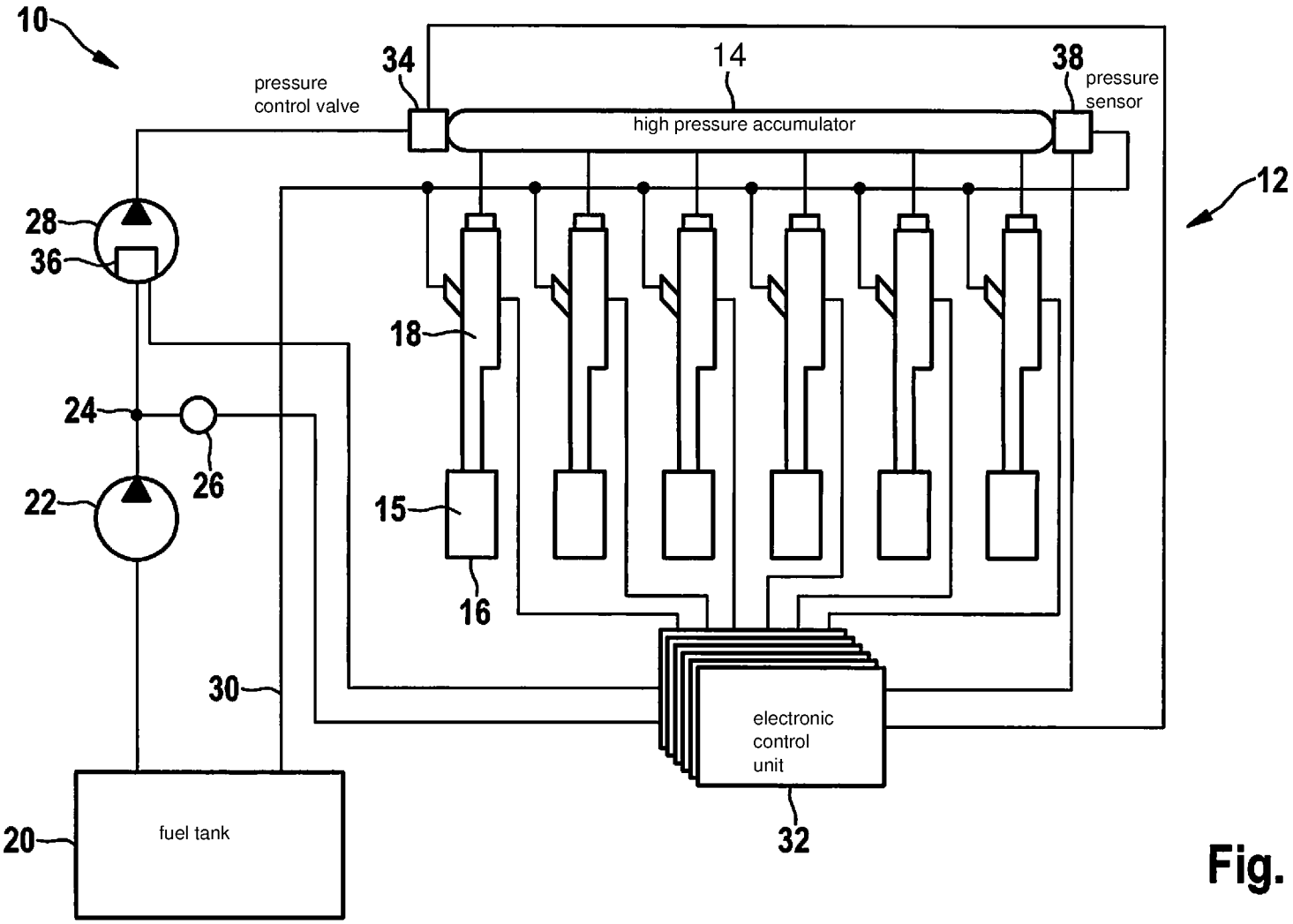
FIG. 1 shows a schematic view of an internal combustion engine including a fuel injection in the form of a common-rail system according to one exemplary embodiment of the present invention.

A six-cylinder internal combustion engine 10 of a diesel motor vehicle includes a fuel injection 12 which is designed as a common-rail system. Fuel injection 12 is configured to withdraw fuel in the form of diesel from a high-pressure accumulator 14 of fuel injection 12 and to inject same into a combustion chamber 15 of cylinders 16 of internal combustion engine 10 with the aid of assigned injectors 18. For the sake of clarity, only one combustion chamber 15, one cylinder 16, and one injector 18 are provided with a reference numeral.

Fuel injection 12 includes a fuel tank 20 which is connected downstream from a fuel delivery pump 22, which is designed as a low-pressure pump, via a corresponding supply line 24. Fuel delivery pump 22 is connected via a pressure control valve 26 in feed line 24 to a high-pressure pump 28 which, in turn, is in fluid connection with high-pressure accumulator 14. The fuel is feedable from high-pressure accumulator 14 to identically designed injectors 18 which are configured to meter the fuel into particular combustion chambers 15 of assigned cylinders 16 which are connected to different injectors 18 in each case. High-pressure accumulator 14 and each injector 18 are connected to fuel tank 20 via a discharge line 30.

In each cylinder 16, a piston (not shown) is provided which is used to compress the free volume of combustion chamber 15 of cylinder 16 and whose movement is used to drive internal combustion engine 10 using a crankshaft (not shown) of internal combustion engine 10.

An electronic control unit 32 according to one exemplary embodiment is configured to activate each injector 18 via an assigned control signal in the form of an activating current in such a way that it opens at a certain opening point in time and closes at a certain closing point in time. The activation period of injector 18 results from the activating current. Control unit 32 is furthermore configured to control a pressure control valve 34, which is situated at high-pressure accumulator 14, and a metering unit 36, which is provided in high-pressure pump 28. It is also possible that common-rail system 12 only includes pressure control valve 34 or metering unit 36. A pressure sensor 38, which is situated at high-pressure accumulator 14, is configured to continuously measure an instantaneous pressure of the fuel in high-pressure accumulator 14 under conditions of angular synchronism. For this purpose, pressure sensor 38 is feedable with voltage by electronic control unit 32 and is configured to output pressure measuring signals which are detected as a function of a rotation angle of the crankshaft, i.e. of the crankshaft angle, to control unit 32. Electronic control unit 32 may, for example, be designed as an electronic engine controller or be a component thereof.

Figure 2:
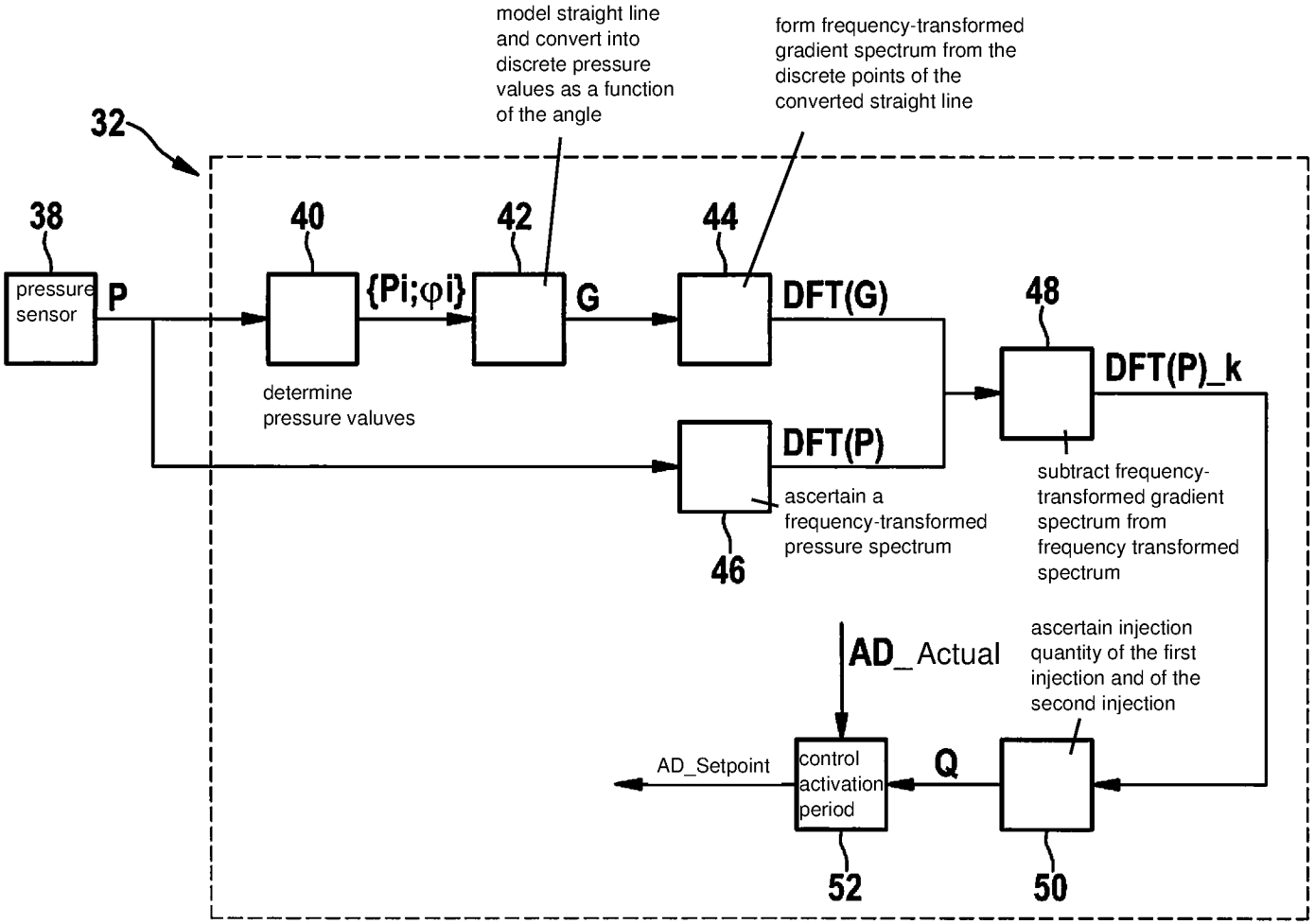
FIG. 2 shows a schematic representation of an electronic control unit for the internal combustion engine in FIG. 1 according to one exemplary embodiment.

Electronic control unit 32 shown in FIG. 2 includes a first unit 40 which determines for pressure values measured under conditions of angular synchronism with the aid of sensor 38 a first and a second evaluation window for a first injection and for a second injection of the fuel with the aid of one of injectors 18 into assigned cylinder 16 and selects a first group of pressure values and a second group of pressure values in the evaluation window assigned to the first injection and to the second injection. Each of the two groups may, for example, include one or multiple point(s) at the beginning of each evaluation window prior to a pressure drop. An output signal of unit 40 which indicates pressure values Pi and their assigned angle values $\varphi i$ as pairs $\{Pi; \varphi i\}$ is feedable to a unit 42 which is configured to ascertain a linear gradient of the measured pressure from the pressure values and assigned angle values of the two groups. For this purpose, unit 42 is configured to model a straight line to the pressure values of the first group and to the pressure values of the second group. A functional parameter of the straight line is crankshaft angle cp. Unit 42 is furthermore configured to convert the modeled straight line into discrete pressure values as a function of the angle. An output signal of unit 42 which indicates the ascertained gradient in the form of the discrete pressure values as a function of the crankshaft angle is feedable to a unit 44 which is configured to form a frequency-transformed gradient spectrum from the discrete points of the converted straight line.

A unit 46 is configured to ascertain a frequency-transformed pressure spectrum DFT(P) from pressure values P detected with the aid of sensor 38. The output signal of unit 44 and the output signal of unit 46, which indicate the particular spectra, are fed to a unit 48 which is configured to subtract frequency-transformed gradient spectrum DFT(G) from frequency-transformed spectrum DFT(P) of the detected pressure to obtain a corrected frequency-transformed pressure spectrum DFT(P)_k. An output signal of unit 48, which indicates difference spectrum DFT(P)_k, is feedable to a unit 50 which is configured to ascertain injection quantity Q of the first injection and of the second injection taking into consideration a model, in that a phase and/or an amplitude of the corrected pressure spectrum in the case of injection frequency fE in the particular frequency-transformed evaluation window is ascertained taking into consideration an underlying model. The model sets injection quantity Q in relation with pressure P and a fluid temperature of the fuel and uses a characteristic map for computing the injection quantity from the ascertained values. Injection frequency fE is known. An output signal of unit 50, which corresponds to injection quantity Q, is feedable to a unit 52 which is configured to control activation period AD of injector 18. Injection quantity Q is used in this case as a reference variable for the control. An actual value of activation period AD_Actual is fed to unit 52 and a setpoint activation period AD_Setpoint is applied to injector 18 as a current.

Figure 3:
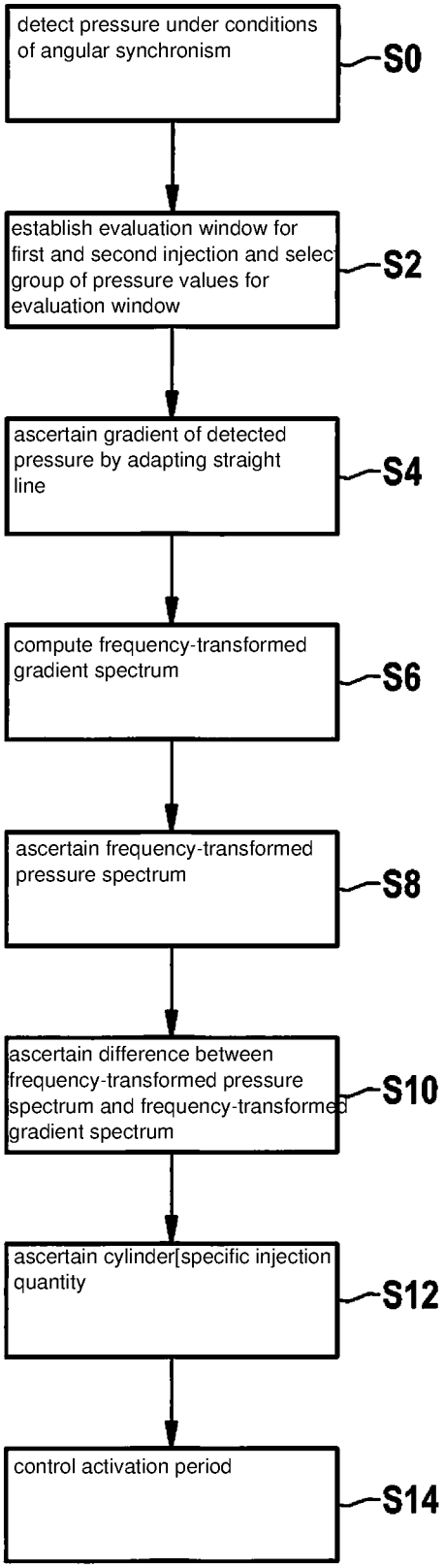
FIG. 3 shows a schematic flow chart of a method according to one exemplary embodiment which is carried out by the electronic control unit in FIG. 2.

In one alternative implementation, electronic control unit 32 includes a processor and a memory of a conventional computer. In the memory, a computer program is stored which is configured to generate the output signal of unit 50 or 52. For better understanding, the method shown in FIG. 3 is described according to one exemplary embodiment for electronic control unit 32 shown in FIG. 2.

Figure 4:
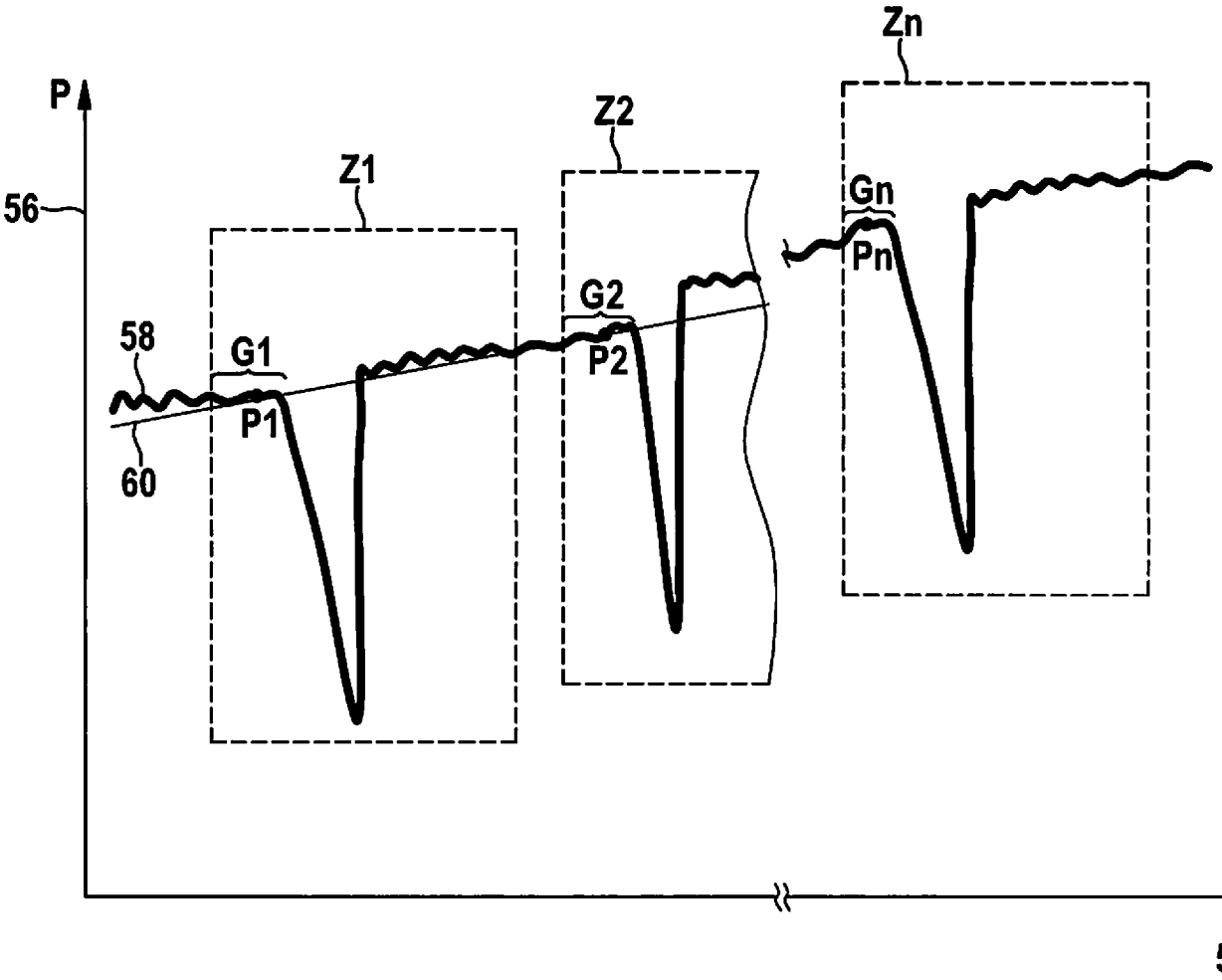
FIG. 4 shows a schematic diagram which illustrates the ascertainment of the gradient from the detected pressure values with the aid of the method shown in FIG. 3.

When control unit 32 is operated, the pressure is detected under conditions of angular synchronism with the aid of sensor 38 in a method for operating internal combustion engine 10 in a first method step S0. In a further step S2, which is carried out by unit 40, the particular evaluation window is established for the first and the second injection and the group of pressure values is selected per evaluation window in each case. FIG. 4 illustrates this method step and shows a diagram in this regard whose x axis 54 shows crankshaft rotation angle φ and y axis 56 shows discrete pressure values P. A curve 58 shows the periodic pressure signal. At an operating point, pressure P may be detected for n injections all of which are taken into consideration in the method, even if the method is described only for two injections for the sake of simplicity. Evaluation windows Z1, Z2 each start shortly prior to a pressure drop in high-pressure accumulator 14 which is caused by the fact that the fuel is fed to considered injector 18. A group G1, G2, . . . , Gn of multiple pressure values is selected and averaged in each case at the beginning of each evaluation window Z1, Z2, . . . , Zn, so that an averaged pressure value P1, P2, . . . , Pn is ascertained in each case. In a further method step S4, which is carried out by unit 42, the gradient of the detected pressure is ascertained by adapting a straight line (curve 60) to points P1, P2. Straight line 60 is converted back into discrete pressure values. In a further method step S6, which is carried out by unit 44, a frequency-transformed gradient spectrum DFT(G) of ascertained gradient 60 is computed with the aid of a discrete Fourier transformation. In a further method step S8, which is carried out by unit 46, a frequency-transformed pressure spectrum DFT(P) is ascertained from the detected pressure (curve 58) with the aid of a discrete Fourier transformation. In a method step S10, which is carried out by unit 48, difference DFT(P)_k between frequency-transformed pressure spectrum DFT(P) and frequency-transformed gradient [spectrum] DFT(G) is ascertained. In a further method step S12, which is carried out by unit 50, cylinder-specific injection quantity Q is ascertained by ascertaining the phase and/or amplitude in the frequency-transformed pressure spectrum for injection frequency fE in each of likewise frequency-transformed evaluation windows Z1, Z2. In a further method step S12, which is carried out by unit 52, a control of activation period AD is carried out for injector 18 having ascertained injection quantity Q as the reference variable for injector 18. A current signal is output to injector 18 which represents a setpoint value for activation period AD_Setpoint of injector 18.

Figure 5:
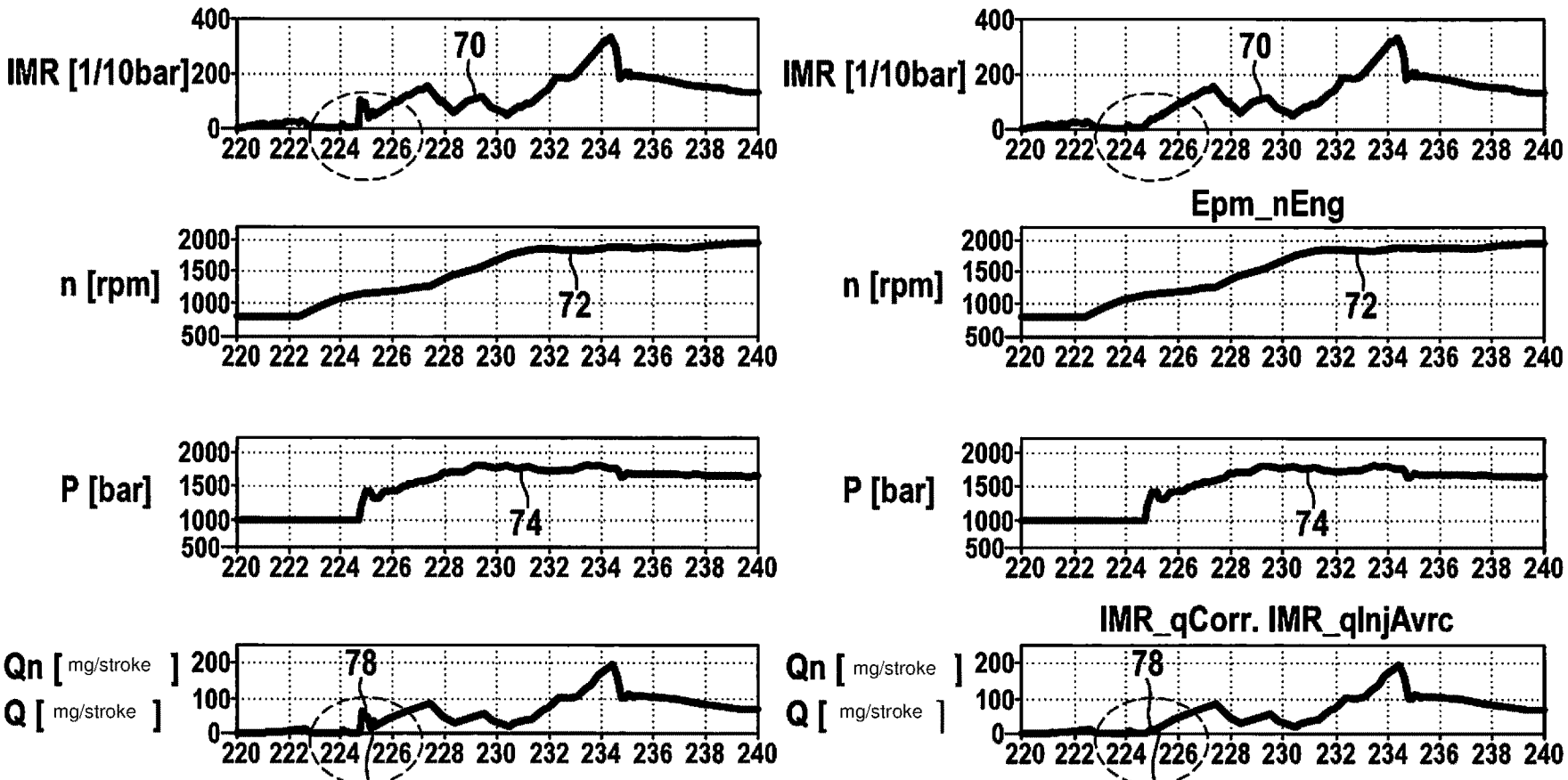
FIG. 5 shows schematic diagrams which show an implementation of the method in FIG. 3 compared to an operation of the internal combustion engine in FIG. 1 without the use of the method in FIG. 3.

FIG. 5 shows a section of measurements which are recorded on an engine test bench. The measurements show an IMR (injection mean rail) amplitude (curve 70) which indicates the spectrum portion (amplitude in the present case) of the frequency-transformed pressure profile for the camshaft frequency times 6 (since a 6-cylinder engine is described) in units of 1/10 bar (bar), a rotational speed n of internal combustion engine 10 in units of rotations per minute (rpm) (curve 72), a rail pressure P in high-pressure accumulator 14 (curve 74) in units of bar, a nominal injection quantity Qn (curve 76) in units of mg/stroke, which is to be expected in a new condition of injector 18, and injection quantity Q (curve 78), ascertained with the aid of the model, in units of mg/stroke as a function of time t in milliseconds. The left-hand side of FIG. 5 shows a computation of modeled injection quantity Q without the use of the method, while a right-hand side of FIG. 5 shows modeled injection quantity Q taking into consideration the method according to the present invention illustrated above. The compensation of the pressure gradient is particularly apparent in the range in which the pressure in high-pressure accumulator 14 drastically increases (by t=225 s). This range is marked by an oval. With the aid of the method according to the present invention, a significant improvement of the computed model injection quantity is achieved. While on the left-hand side of FIG. 5 significant deviations are apparent between nominal injection quantity Qn and ascertained model injection quantity Q in the case of strong pressure gradients, on the right-hand side of FIG. 5, model injection quantity Q nicely follows nominal injection quantity Qn.

What is claimed is:

1. A method for operating an internal combustion engine in which fuel is withdrawn from a high-pressure accumulator and injected into a combustion chamber of at least one cylinder of the internal combustion engine, the method comprising:

detecting, under conditions of angular synchronism, a pressure of the fuel in the high-pressure accumulator during a first injection into the at least one cylinder and during a later, second injection into the at least one cylinder;

ascertaining a gradient of the detected pressure;

ascertaining a frequency-transformed spectrum of the detected pressure and a frequency-transformed spectrum of the ascertained gradient;

correcting the frequency-transformed spectrum of the detected pressure by the frequency-transformed spectrum of the ascertained gradient;

ascertaining a cylinder-individual injection quantity of the fuel, which was injected into the at least one cylinder, from the corrected frequency-transformed spectrum of the detected pressure; and controlling a further injection into the at least one cylinder based on the ascertained cylinder-individual injection quantity.

2. The method as recited in claim 1, wherein the gradient is ascertained by modeling a pressure change between the first injection and the second injection with the aid of a linear function.

3. The method as recited in claim 1, wherein a first group of pressure values is taken into consideration in a first evaluation window for the first injection and a second group of pressure values is taken into consideration in a second evaluation window for the second injection when ascertaining the gradient.

4. The method as recited in claim 3, wherein the first group and/or the second group includes one pressure value or multiple pressure values.

5. The method as recited in claim 3, wherein the pressure increases over a detection period and the gradient is adapted to the first group of pressure values and to the second group of pressure values as a linearly ascending straight line.

6. The method as recited in claim 3, wherein the first group of pressure values is selected at a beginning of the first evaluation window and/or the second group of pressure values is selected at a beginning of the second evaluation window.

7. The method as recited in claim 1, wherein the correcting includes forming a difference between the frequency-transformed spectrum of the detected pressure and the frequency-transformed spectrum of the ascertained gradient.

8. An electronic control unit for an internal combustion engine in which fuel is withdrawn from a high-pressure accumulator and injected into a combustion chamber of at least one cylinder of the internal combustion engine, the electronic control unit configured to:

detect, under conditions of angular synchronism, a pressure of the fuel in the high-pressure accumulator during a first injection into the at least one cylinder and during a later, second injection into the at least one cylinder;

ascertain a gradient of the detected pressure;

ascertain a frequency-transformed spectrum of the detected pressure and a frequency-transformed spectrum of the ascertained gradient;

correct the frequency-transformed spectrum of the detected pressure by the frequency-transformed spectrum of the ascertained gradient;

ascertain a cylinder-individual injection quantity of the fuel, which was injected into the at least one cylinder, from the corrected frequency-transformed spectrum of the detected pressure; and control a further injection into the at least one cylinder based on the ascertained cylinder-individual injection quantity.

9. A non-transitory machine-readable memory medium on which is stored a computer program for operating an internal combustion engine in which fuel is withdrawn from a high-pressure accumulator and injected into a combustion chamber of at least one cylinder of the internal combustion engine, the computer program, when executed by a processor, causing the processor to perform:

detecting, under conditions of angular synchronism, a pressure of the fuel in the high-pressure accumulator during a first injection into the at least one cylinder and during a later, second injection into the at least one cylinder;

ascertaining a gradient of the detected pressure;

ascertaining a frequency-transformed spectrum of the detected pressure and a frequency-transformed spectrum of the ascertained gradient;

correcting the frequency-transformed spectrum of the detected pressure by the frequency-transformed spectrum of the ascertained gradient;

ascertaining a cylinder-individual injection quantity of the fuel, which was injected into the at least one cylinder, from the corrected frequency-transformed spectrum of the detected pressure; and controlling a further injection into the at least one cylinder based on the ascertained cylinder-individual injection quantity.

* * * * *